United States Patent [19]

Bleyer

[11] Patent Number: 4,562,721

[45] Date of Patent: Jan. 7, 1986

[54] MACHINE FOR FOLDING SHEET METAL BLANKS

[75] Inventor: Franz Bleyer, Vienna, Austria

[73] Assignee: Peter Wukovich OHG, Vienna, Austria

[21] Appl. No.: 583,105

[22] Filed: Feb. 24, 1984

[30] Foreign Application Priority Data

Mar. 8, 1983 [DE] Fed. Rep. of Germany ..... 3308219

[51] Int. Cl.[4] ..... B21D 17/02

[52] U.S. Cl. ..... 72/384; 72/210; 72/387; 72/404

[58] Field of Search ..... 72/76, 176, 210, 384, 72/387, 404; 29/243.58

[56] References Cited

U.S. PATENT DOCUMENTS 4,060,046 11/1977 Eckold et al. .
4,181,002 1/1980 Eckhold ..... 72/387
4,372,022 2/1983 Puckett .
4,434,644 3/1984 Gargrave ..... 72/387

FOREIGN PATENT DOCUMENTS 511460 10/1930 Fed. Rep. of Germany .
2522752 2/1978 Fed. Rep. of Germany .
2714427 11/1980 Fed. Rep. of Germany .
3120514 1/1983 Fed. Rep. of Germany .
620609 12/1980 Switzerland .

*Primary Examiner*—Lowell A. Larson
*Assistant Examiner*—Robert Showalter
*Attorney, Agent, or Firm*—Harness, Dickey & Pierce

[57] ABSTRACT

The invention relates to a machine for folding sheet metal blanks. For folding a sheet metal blank, there is provided at least one folding member having a folding surface and being driven by an eccenter to perform a reciprocating beat movement. The sheet metal blank is drawn into the gap between the folding member and a stationary anvil for folding. The folding member is pivotally mounted in a holder for ease of operation and to obtain a neat folding. So the folding member is adapted to adjust to the instantaneous resistance of deformation of the sheet metal blank. If a sheet metal blank is to be folded twice, a corresponding second folding member, which is also pivotally mounted in a holder, is disposed downstream of the first folding member.

12 Claims, 10 Drawing Figures

FIG. 6
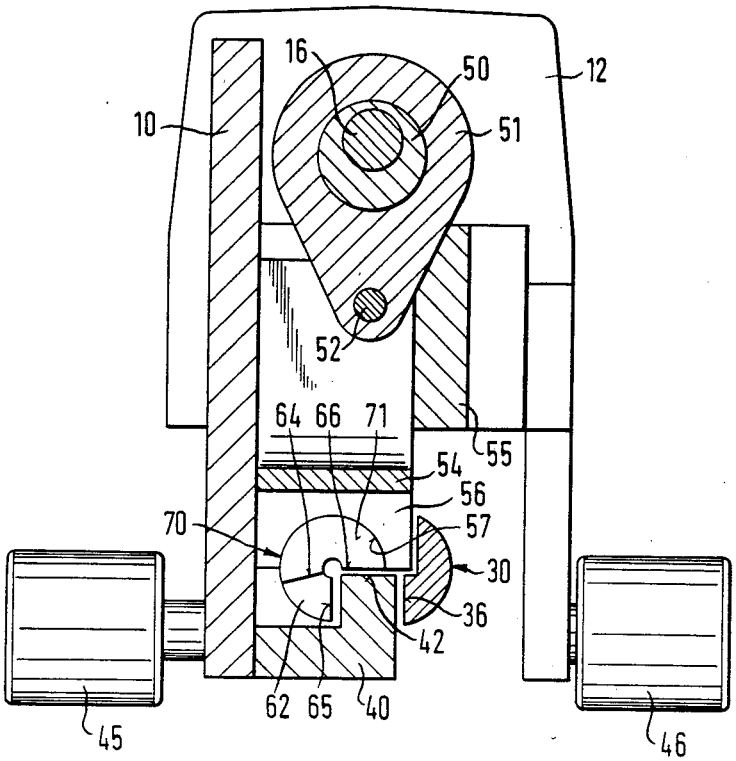
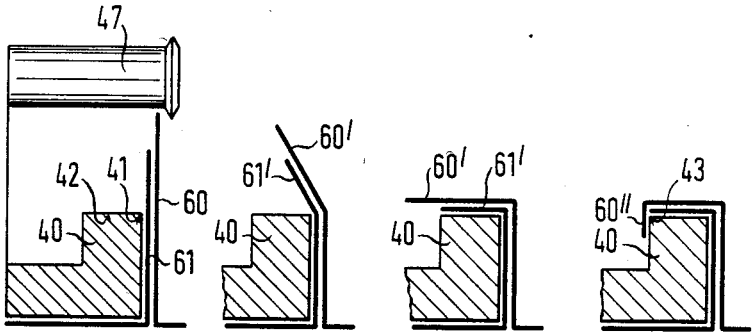
FIG. 7A FIG. 7B FIG. 7C FIG. 7D

MACHINE FOR FOLDING SHEET METAL BLANKS

The invention refers to a machine for folding sheet metal blanks.

Machines for closing folds of sheet metal blanks have become known, e.g. by applicant's German specification Nos. 25 22 752, 27 14 427 and 31 20 514. These machines serve to simultaneously deform a pair of already folded sheet metal blanks in order to unite them by a fold.

In order to be able to use these fold closing machines, the sheet metal blanks must be prefolded. To this end machines have been used which are heavy and not easy to handle. They are not adapted to be used, for example, on a roof.

An object of the present invention is to provide a machine for folding sheet metal blanks, which machine is easy to operate and of reduced weight.

This object as well as other objects are achieved by the machine of the present invention as defined in patent claim 1. The machine of the present invention is adapted to fold one or even two sheet metal blanks such as to assume a rectangular profile. It allows to prefold sheet metal blanks which thereafter are further deformed by a fold closing machine as shown in German specification No. 31 20 514. So the present machine may be considered to be supplemental the fold closing machine of German specification No. 31 20 514.

The machine of the present invention allows for ease of operation requiring only small advancing forces. The sheet metal blanks are neatly and uniformly folded about 90°. If straps or brackets are inserted between the upfolded sheet metal blanks in order to mount the sheet metal members upon a roof surface, the brackets and straps are also neatly folded about 90° by the machine when folding the sheet metal blanks.

This is achieved in particular by the folding member being freely pivotal in a holder, which together with the folding member form a jaw for performing a beat movement. So the folding member is not fixed but freely pivotal in order to adjust in accordance with the instantaneous resistance of deformation of the sheet metal blank.

Preferred embodiments and further developments of the invention are defined in the subclaims. This is true in particular with respect to the features of claim 5 according to which a second folding member which is also pivotally mounted in a holder is disposed downstream of the first folding member, which second folding member serves to form a second fold as required by the fold closing machine of German No. 31 20 514.

The present machine is provided with simple and reliable drives, has reduced space requirements and is of substantially reduced weight so that it is altogether easy to handle.

Figure 1:
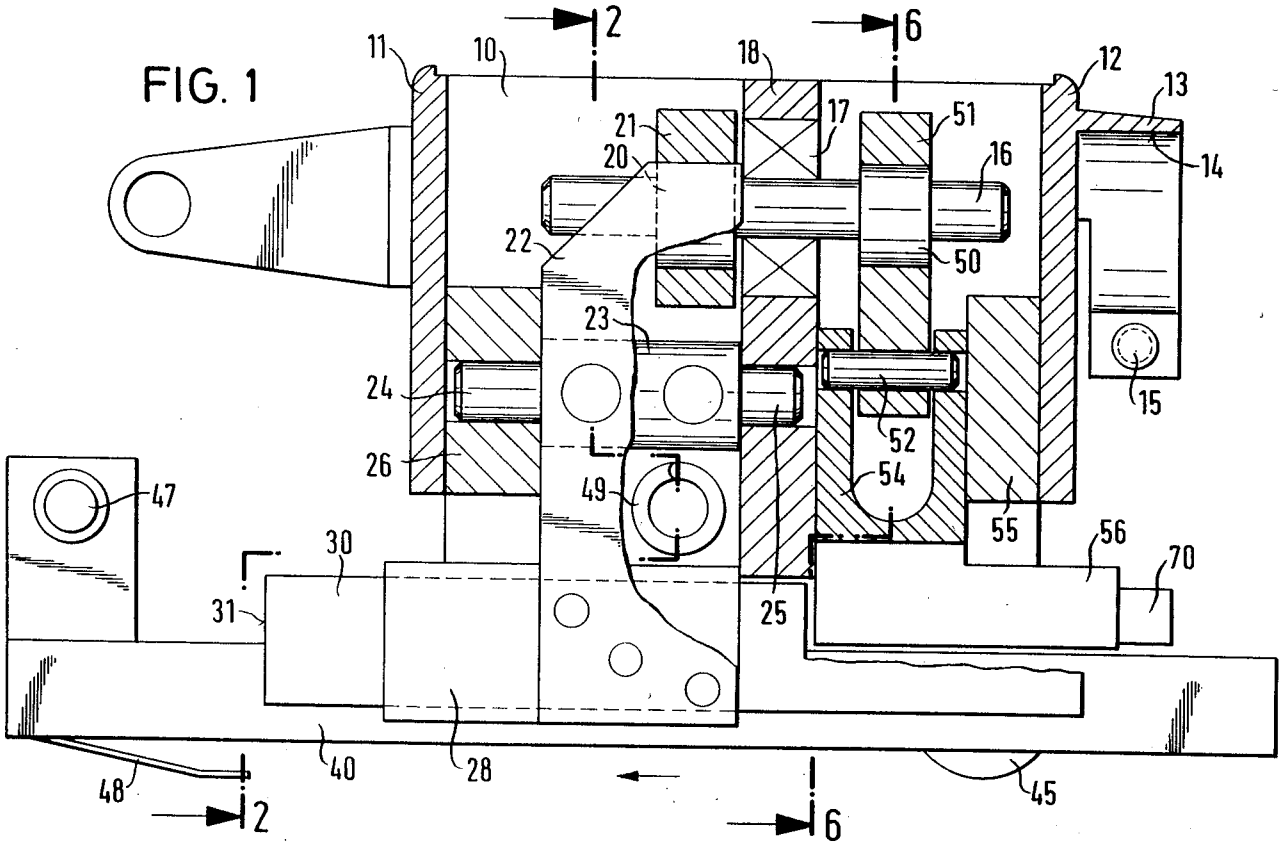
Figure 2:
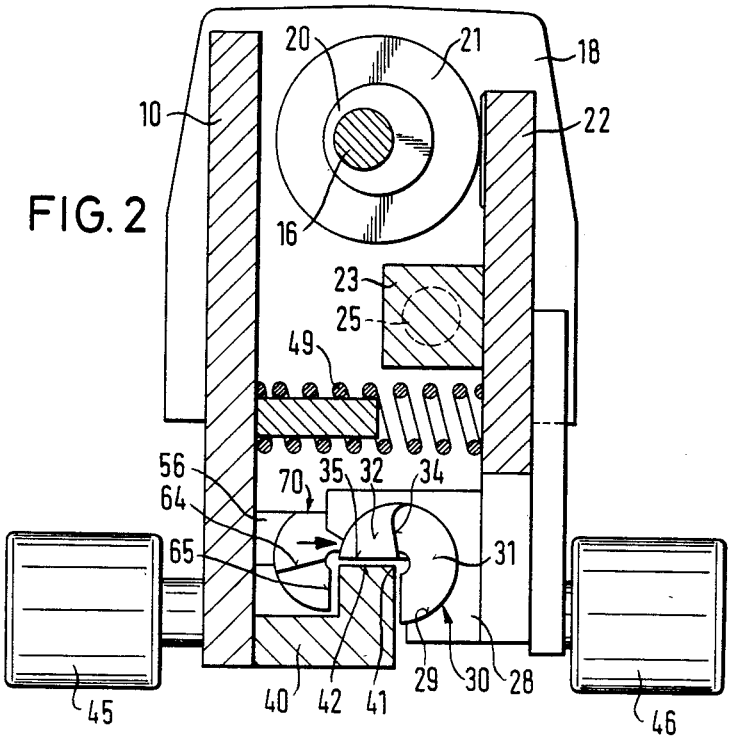
Figure 3:
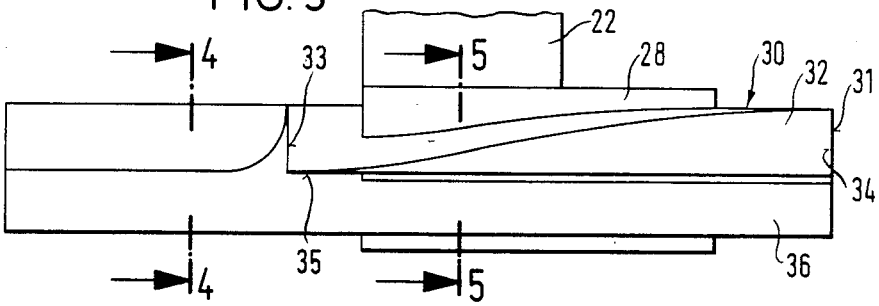
Figure 4:
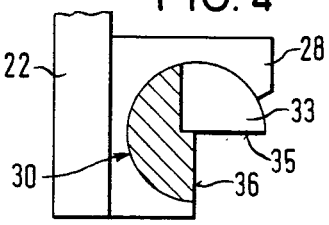
Figure 5:
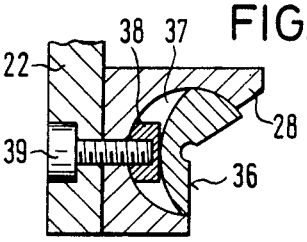

A preferred embodiment of the invention will now be described, by way of example, with reference to the accompanying drawings, in which:

FIG. 1 is a longitudinal section of a machine for folding sheet metal blanks;

FIG. 2 a cross-section along line 2—2 in FIG. 1;

FIG. 3 a view of the first folding member together with a holder of the machine as seen in the direction of the arrow in FIG. 2;

FIG. 4 a cross-section of the first folding member along line 4—4 in FIG. 3;

FIG. 5 a cross-section of the first folding member along line 5—5 in FIG. 3;

FIG. 6 a cross-section of the machine along line 6—6 in FIG. 1;

FIGS. 7A to 7D a diagrammatic view showing the operation of folding a pair of adjacent sheet metal blanks.

The housing of the machine as shown in FIGS. 1 to 3 comprises a housing plate 10 and a pair of end plates 11,12 bolted to the faces of housing plate 10. End plate 12 supports an extension 13 having a bore 14 into which a cylindrical mounting flange of a drive (not shown) may be inserted to be clamped therein by means of a mounting bolt 15. The shaft of the drive is connected to a shaft 16 in a manner not shown. Shaft 16 is mounted for rotation by a bearing 17 which is mounted in a bearing plate 18 connected to housing plate 10 to extend perpendicularly thereto.

Shaft 16 is provided with a first eccentric 20 on which a bearing sleeve 21 is mounted for rotation. If shaft 16 is rotated, bearing sleeve 21 performs an eccentric movement for driving a lever 22. Lever 22 is connected to a bearing member 23 which is rotatably mounted in a bore of a bearing plate 18 and a bore of a bearing block 26 by means of trunnions 24 and 25, respectively. A holding member 28 is fixed to a free end of lever 22, which holding member 28 is provided with a partially cylindrical bore 29 which rotatably receives a first folding member 30 of also partially cylindrical shape. In FIG. 2, a downstream face of folding member 30 is designated by 31 and the folding surface by 32.

The first folding member 30 is shown in FIG. 3 in a side view as seen in the direction of the arrow in FIG. 2. Folding surface 32 extends from face 31 to an end face 33 in the direction of operation. Folding surface 32 has the purpose of folding adjacent portions 60', 61' of sheet metal blanks 60, 61 about 90° as shown in FIGS. 7A to 7C. To this end the first folding member 30 cooperates with a stationary anvil 40 fixed to housing plate 10. The sheet metal blanks 60, 61 are folded about edge 41 of anvil 40 by the first folding member 30, as shown in FIG. 7B, to have portions 60', 61' abut surface 42 of anvil 40.

The folding surface 32 extends from an upstream edge 34 at face 31 to a downstream edge 35 at end face 33, while being twisted so that upstream edge 34 is substantially perpendicular to downstream edge 35. A beat surface 36 extends substantially over the entire length of the first folding member 30, which beat surface 36 is disposed substantially in the same plane as upstream edge 34.

The first folding member 30 is pivotally mounted in holding member 28. As is shown in FIG. 5, folding member 30 has a transverse groove 37 receiving a shoe 38 which is fixed to lever 22 by means of a bolt 39. Groove 37 has a form so as to allow for a limited rotational movement of folding member 30 while preventing an axial movement thereof.

Folding member 30 being rotatably mounted in holding member 28 allows for neat and uniform folding of the sheet metal blanks about 90°. While folding member 30 performs a beat movement as caused by eccentric drive 20, 21, 22, folding member 30 rotatably adjusts according to the instantaneous resistance of deformation of the sheet metal blanks. In FIG. 2 folding member 30 is shown in a position to have reached the end position of a beat movement when downstream edge 35 extends parallel to surface 42 of stationary jaw 40. However, folding member 30 is not forced to reach this end position during each beat movement due to its pivotal mounting. This allows for ease of operation of the machine. While the sheet metal blanks run between the upstream edge 34 and the downstream edge 35, the end position of folding member 30 as shown in FIG. 2 is reached often enough to allow for neatly and uniformly folding about 90°.

During operation the machine is advanced by rollers 45,46 mounted on opposite sides of the housing in the direction of the arrow in FIG. 1. At the front end of the machine there is provided a guide pin 47 which is adapted to be adjusted to the height of the sheet metal blanks as shown in FIG. 7A. By means of a spring 48 the front end of the machine is raised. Lever 22 is urged in abutment with bearing sleeve 20 by means of a spring 49. Furthermore, spring 49 serves to return lever 22 and folding member 30. FIG. 7D shows the manner in which projecting edge 60'' of sheet metal blank 60 is additionally folded about an edge 43 of anvil 40. To this end shaft 16 is provided with a second eccentric 50 which is rotatably mounted on a crank 51. Crank 51 drives via a trunnion 52 a shoe 54 which is displaceably guided on housing plate 10, bearing plate 18 and a further plate 55. If shaft 16 together with eccentric 50 is rotated, shoe 54 performs an up and down movement. A holding member 56 is fixed to the lower end of shoe 54, which holding member 56 has a partially open bore 57. A second folding member 70 is mounted in bore 57 for rotation about its longitudinal axis. Second folding member 70 has a downstream face 71 and a folding surface 62 which extends from upstream edge 64 at face 71 to a downstream edge 65 at the downstream end of folding surface 62 in a twisted manner. When the machine is advanced, projecting edge 60'' of sheet metal blank is bent about edge 43 and folded about 90° as shown in FIG. 7D. Furthermore, the second folding member 70 is provided with a beat surface 66 extending rectangularly to downstream edge 65. Beat surface 66 is effective to urge portions 60',61' against surface 42 of anvil 40.

Due to its rotatable mounting the second folding member 70 is adapted to adjust to the momentaneous resistance of deformation of the sheet metal flange in substantially the same manner as described with respect to the first folding member, the end position as shown in FIG. 6 being reached often enough to allow for a neat and uniform folding about 90°.

Also the second folding member 70 is prevented from an axial displacement in holding member 56. A mounting substantially as shown in FIG. 5 may be used.

As shown in FIGS. 1 and 3, the beat surface 36 of the first folding member 30 is extended in the direction of operation so that beat surface 36 is effective also in the area of the second folding member 70. The extension of beat surface 36 of the first folding member 30 is also shown in FIG. 6.

Eccentric drives 20, 21 and 50, 51 are offset with respect to each other about 90°. If the first folding member 30 engages anvil 40 with eccentric 20 being in an angular position of e.g. 0°, engagement of the second folding member 70 occurs thereafter when the eccenter 20 is in an angular position of 90°. At this time the first folding member 30 has already been partially opened, and the opening movement of the second holding member 70 begins. During the time when the two folding members do not engage the anvil and the sheet metal blanks, the machine may be easily advanced resulting in ease of operation requiring no substantial advancing forces.

What I claim is:

1. A machine for folding sheet metal blanks, comprising a stationary jaw and an opposite jaw movable between a retracted position and a bending position for performing a movement of beating against said stationary jaw, said driven jaw being provided with a folding surface curved to form a progressive fold as sheet metal blanks are progressively acted upon by said jaws, characterized in that a first folding member comprising said curved folding surface is mounted in a holder for pivotal movement about a longitudinal axis, while being prevented from an axial movement for adjustment of said folding surface in response to momentaneous resistance of said sheet metal blanks to deformation, a second folding member disposed downstream of said driven jaw as seen in the direction of operation, said second folding member being associated with a drive for performing a beat movement transverse to the direction of movement of said driven jaw and being provided with a folding surface, said second folding member serving to fold the sheet metal blank already folded by the driven jaw a second time and said second folding member being mounted in a holder for pivotal movement about its longitudinal axis while being prevented from an axial movement.

2. A machine according to claim 1, characterized in that said first folding member has a partly cylindrical cross-section and is disposed in a partially open longitudinal bore of the holder which defines the longitudinal axis.

3. A machine according to claim 1 characterized in that said first folding member is provided with a beat surface perpendicular generally to said folding surface.

4. A machine according to claim 1, characterized in that said first folding member is provided with a groove receiving a shoe mounted on said holder for axially restraining said folding member.

5. A machine according to claim 1, characterized in that the first mentioned folding member is provided with an extension in the direction of operation, which extension substantially extends to the end of the second folding member.

6. A machine according to claim 1, characterized in that the stationary jaw extends along the first mentioned and second folding members.

7. A machine according to claim 1, characterized in that said stationary jaw comprises a rail member connected to a housing.

8. A machine according to claim 1, characterized in that the holder of the first folding member is fixed to a pivotally mounted lever having a free end driven by a bearing sleeve enclosing an eccentric of a drive shaft.

9. A machine according to claim 7, characterized in that the holder of the second folding member is fixed to a shoe displaceably mounted in a housing, which soe is driven by a crank enclosing an eccentric of a drive shaft.

10. A machine according to claim 1, characterized in that a guide for holding a pair of adjacent sheet metal blank portions is provided upstream of the first folding member along a rail member as seen in the direction of operation.

11. A machine according to claim 1, characterized in that there are provided rollers for supporting and advancing the machine.

12. A machine according to claim 2, characterized in that said first folding member is provided with a groove receiving a shoe mounted on said holder.

* * * * *